US007002546B1

(12) United States Patent
Stuppi et al.

(10) Patent No.: US 7,002,546 B1
(45) Date of Patent: Feb. 21, 2006

(54) LUMINANCE AND CHROMATICITY CONTROL OF AN LCD BACKLIGHT

(75) Inventors: Albert N. Stuppi, Marion, IA (US); Rick J. Johnson, Marion, IA (US); Joseph H. Briley, Marion, IA (US); Donald E. Mosier, Cedar Rapids, IA (US); William G. Perreault, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 419 days.

(21) Appl. No.: 10/146,510

(22) Filed: May 15, 2002

(51) Int. Cl.
*G09G 3/36* (2006.01)

(52) U.S. Cl. ..... 345/102; 345/207; 345/690; 349/30; 349/61; 362/30; 362/246; 362/800

(58) Field of Classification Search ..... 345/102, 345/82, 83, 46, 48, 39, 87, 88, 207; 362/30, 362/246, 800; 349/30, 61
See application file for complete search history.

(56) References Cited

U.S. PATENT DOCUMENTS

| | | | | |
|---|---|---|---|---|
| 4,962,687 | A | 10/1990 | Belliveau et al. | 84/464 R |
| 5,724,062 | A * | 3/1998 | Hunter | 345/102 |
| 6,007,209 | A * | 12/1999 | Pelka | 362/30 |
| 6,115,016 | A * | 9/2000 | Yoshihara et al. | 345/88 |
| 6,519,012 | B1 * | 2/2003 | Helbing et al. | 349/30 |
| 6,559,826 | B1 * | 5/2003 | Mendelson et al. | 345/102 |
| 6,608,614 | B1 * | 8/2003 | Johnson | 345/102 |
| 6,680,578 | B1 * | 1/2004 | Antoniadis et al. | 315/169.3 |
| 6,888,529 | B1 * | 5/2005 | Bruning et al. | 345/102 |
| 2001/0035853 | A1 * | 11/2001 | Hoelen et al. | 345/102 |
| 2002/0070914 | A1 * | 6/2002 | Bruning et al. | 345/102 |
| 2003/0006980 | A1 * | 1/2003 | Brabander et al. | 345/207 |
| 2003/0043107 | A1 * | 3/2003 | Ruby et al. | 345/102 |
| 2004/0046720 | A1 * | 3/2004 | Nagai et al. | 345/82 |

OTHER PUBLICATIONS

"FIMI Philips MCL1501 15.1—inch LCD Monitor with LED Backlight" (Undated Preliminary Product Specification).
"LumiLeds' High-Flux LEDs to Power New Medical Monitors from FIMI Philips." PanelX.com, Feb. 5, 2002.

* cited by examiner

*Primary Examiner*—Henry N. Tran
(74) *Attorney, Agent, or Firm*—Nathan O. Jensen; Kyle Eppele

(57) ABSTRACT

A variably controlled LCD backlight is disclosed. The backlight includes a first light source that emits light within a first spectral power distribution and has a first radiant power output. A second light source emits light within a second spectral power distribution and has a second radiant power output. A detector detects the first and second radiant power outputs. A processor is connected to the detector and calculates chromaticity and luminance values of the emitted light based on the first and second radiant power outputs. The processor compares the calculated chromaticity and luminance values with desired chromaticity and luminance values, respectively. A controller is operationally connected to the processor and adjusts one or more of the first radiant power output and the second radiant power output in response to a difference between the calculated chromaticity and luminance values and the desired chromaticity and luminance values.

19 Claims, 3 Drawing Sheets

LUMINANCE AND CHROMATICITY CONTROL OF AN LCD BACKLIGHT

FIELD OF THE INVENTION

The invention relates to displays, and more particularly, to a backlight for an LCD display.

BACKGROUND OF THE INVENTION

Light-emitting diode (LED) arrays have shown great potential as a light source in liquid-crystal display (LCD) backlighting systems. When compared to other light sources such as incandescent or fluorescent light sources, LED arrays are desirable for their low-temperature performance, ease of heat-sinking, dimming range, small size, low power consumption, relatively low cost, luminous efficacy, and directional emission.

Some LCD backlights are required to emit light of a certain chromaticity and luminance. Other backlights are required to perform in multiple viewing modes, each of the modes having different chromaticity and luminance requirements. For example, an avionics LCD display may be required to perform in a daylight viewing mode as well as in a night-time viewing mode, and the luminance and chromaticity requirements for the viewing modes are vastly different from each other. In such circumstances, it would be helpful to control the luminance and chromaticity of the backlight.

One problem with adjusting the luminance and chromaticity of a backlight is that some backlights use a plurality of light sources that emit light having different luminances and chromaticities. For example, an LED-based backlight may use different colors of LEDs that, when properly mixed, produce light having a desired chromaticity and luminance. However, once the light is properly mixed, it is difficult to reduce the luminance throughout the entire dimming range while maintaining a stable chromaticity. This makes chromaticity control difficult.

It is therefore an object of the invention to provide an LCD backlighting system that can be customized to provide light with a desired chromaticity range.

It is another object of the invention to provide an LCD backlight that provides light having good color uniformity.

It is yet another object to provide an optical feedback system that controls luminance and chromaticity of an LCD backlight having light sources with different spectral outputs.

A feature of the invention is the use of pulse-width modulation techniques to isolate and measure differently-colored light sources in a backlight.

Another feature of the invention is the use of one or more detectors that detect predetermined tri-stimulus values, which are then used to determine chromaticity and luminance of emitted light.

An advantage of the invention is that commonly-available LEDs may be used to produce an LCD backlight with a customizable chromaticity.

SUMMARY OF THE INVENTION

The invention provides a variably controlled LCD backlight. The backlight includes a first light source that emits light within a first spectral power distribution and has a first radiant power output. A second light source emits light within a second spectral power distribution and has a second radiant power output. A detector detects the first and second radiant power outputs. A processor is connected to the detector and calculates chromaticity and luminance values of the emitted light based on the first and second radiant power outputs. The processor compares the calculated chromaticity and luminance values with desired chromaticity and luminance values, respectively. A controller is operationally connected to the processor and adjusts one or more of the first radiant power output and the second radiant power output in response to a difference between the calculated chromaticity and luminance values and the desired chromaticity and luminance values.

The invention also provides a method of controlling chromaticity and luminance levels of an LCD backlight. A first light source is provided that emits light within a first spectral power distribution. A second light source is provided that emits light within a second spectral power distribution. A predetermined tri-stimulus value of light emitted by the first and second light sources is detected. Chromaticity and luminance values of the emitted light are calculated based on the predetermined tri-stimulus value. The calculated chromaticity and luminance values are compared with desired chromaticity and luminance values, respectively. One or more of an intensity of the first light source and an intensity of the second light source are adjusted in response to a difference between the calculated chromaticity and luminance values and the desired chromaticity and luminance values.

The invention further provides an optical feedback and control system for an LCD backlight having a first light source and a second light source, each of the light sources emitting light having a different spectral power distribution. A detector detects radiant power of light emitted by the first and second light sources. A processor is connected to the detector and calculates chromaticity and luminance values of the emitted light based on the detected radiant power and the spectral power distribution of each of the first and second light sources. The processor compares the calculated chromaticity and luminance values with desired chromaticity and luminance values, respectively. A controller is operationally connected to the processor. The controller adjusts one or more of the radiant power of the first light source and the radiant power of the second light source in response to a difference between the calculated chromaticity and luminance values and the desired chromaticity and luminance values.

DETAILED DESCRIPTION OF THE DRAWINGS

Figure 1:
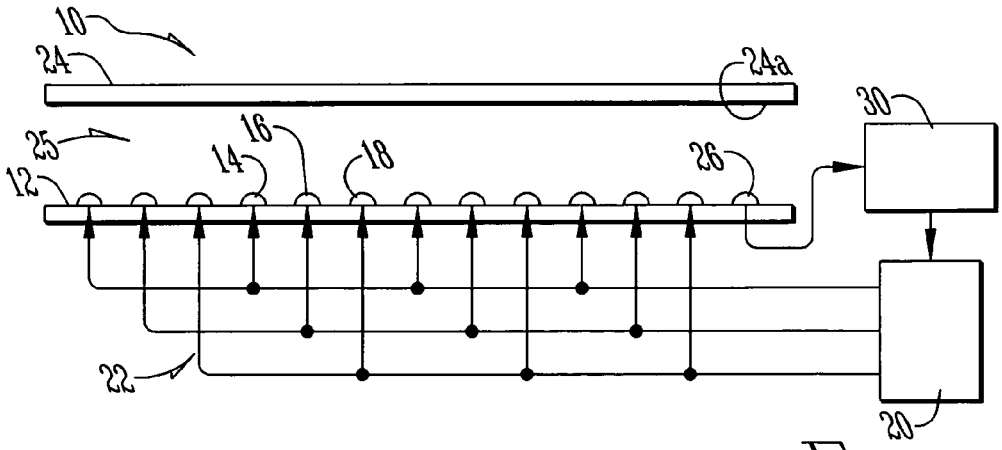
FIG. 1 is a schematic side elevational view of an LED-based LCD backlight according to an embodiment of the invention.
Figure 2:
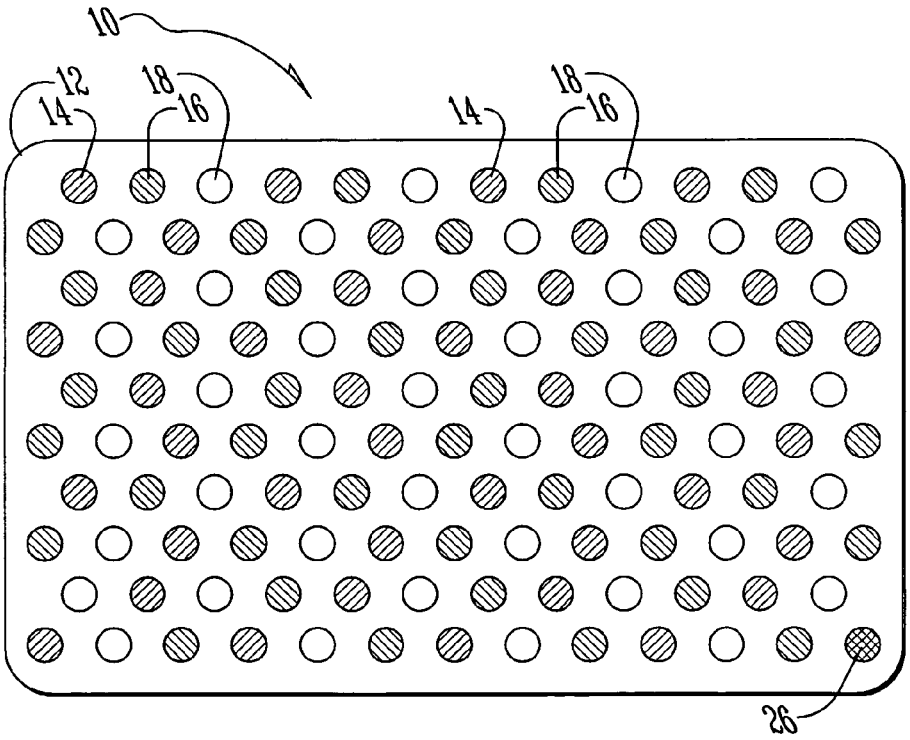
FIG. 2 is a vertical plan view of the LCD backlight shown in FIG. 1.

Turning now to the Figures, in which similar reference numbers refer to similar components, An LCD backlight system according to a preferred embodiment of the invention is shown in FIGS. 1 and 2 and is indicated generally by reference number 10. Backlight system 10 includes a printed wiring board 12 upon which a plurality of light-emitting diodes (LEDs) are mounted. In this embodiment, the LED's include a red LED array 14 comprising a plurality of red LEDs, a green LED array comprising a plurality of green LEDs 16, and a blue LED array 18 comprising a plurality of blue LEDs. The precise number, color, and placement of the red, green and blue LED arrays depend on the luminance and chromaticity that is desired from the backlight. In FIGS. 1 and 2, the red, green and blue LED arrays comprise equal numbers of LEDs, and the differently colored LEDs are evenly distributed upon the printed wiring board.

LED arrays 14, 16, 18 are connected to a controller 20 by electrical circuitry 22. Controller 20 provides a variable electrical current to each of the LEDs to vary the radiant power output of the LEDs. Controller 20 is also capable of controlling the radiant power output of the LEDs through pulse width modulation techniques, in which current to the LEDs is turned on and off for predetermined times.

An optical mixing device such as a diffuser 24 is placed between LEDs 14, 16, 18 and the LCD stack (not shown). Diffuser 24 is substantially planar and is preferably made of translucent plastic or other suitable material. Light from the LEDs is intermixed in the free space 25 between board 12 and diffuser 24, and is further mixed within the diffuser to provide a homogeneous light source for the LCD. A detector 26, which in the present embodiment is a photodiode, is situated on printed wiring board 12 and detects the intensity of the portion of the LED light that has reflected off of a surface 24*a* of the translucent diffuser.

Figure 3:
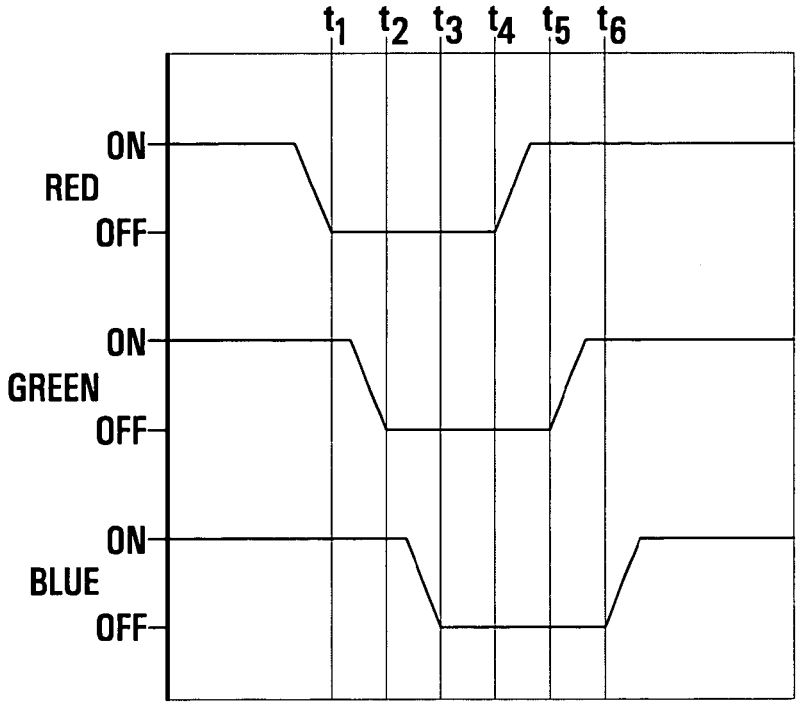
FIG. 3 is a timing diagram usable with the backlight shown in FIGS. 1 and 2.

Using pulse-width modulation techniques, light from each of the red, green and blue LED arrays may be individually measured by detector. The light emitted by each of the LED arrays is isolated from the other LED arrays by staggering the "off" signals sent to each of the LED groups during a pulse-width modulation cycle. The timing diagram shown in FIG. 3 shows how this may be accomplished. According to the timing diagram, red LED array 14 is turned off first at time $t_1$. Green LED array 16 is next turned off at time $t_2$, and blue LED array 18 is turned off at time $t_3$. At time $t_4$, the red LED array is again activated; at time $t_5$, the green LED array is activated; and at time $t_6$ the blue LED array is activated. The intensity of light from blue LED array 16 may be detected between time $t_2$ and time $t_3$ because during that time only the blue LED array is activated. The intensity of light from red LED array 14 may be detected between time $t_4$ and time $t_5$ because during that time only the red LED array is activated. The intensity of light from green LED array 16 may be detected by rearranging the order in which the LED arrays are switched on and off in a subsequent cycle. In this fashion, a single detector can separately measure the intensity of light from each of the red, green, and blue LED arrays. It should be mentioned that for a typical pulse width frequency of 100 Hertz, the elapsed time between time $t_1$ and time $t_2$ (and between times $t_2$ and $t_3$, etc.) in FIG. 3 may be measured in milliseconds.

Detector 26 is connected to a processor 30. The processor calculates a resulting mixed chromaticity and luminance contributions for each of red, green, and blue LED arrays 14, 16, 18 based on signals received from the detector. This may be accomplished by assuming that the measurable intensities, or radiant power outputs, of the LED arrays are proportional to the chromaticity and luminance of the LED arrays. Prior to deploying and operating the backlight, the intensities of the LED arrays are measured at the desired chromaticity and luminance levels. Then, during operation, processor 30 determines the chromaticity and luminance of each LED array based on the detected intensity of the light from each array. Processor 30 compares the combined luminance of the red, green and blue LED arrays, which comprises the total luminance of the LCD backlight, with a desired or predetermined total backlight luminance. The processor also compares the calculated chromaticity values for each of the red, green, and blue LED arrays with desired or predetermined chromaticity values. If there is a difference between the calculated values and the desired values of luminance and/or chromaticity, the processor sends commands to controller 20 to adjust the output of one or more of the LED arrays. This is accomplished either by adjusting the peak current to an LED array, or by adjusting the pulse length of the current to the LED array. The chromaticity of the output light is reasonably controlled by maintaining a defined luminance ratio between red, green, and blue LED arrays.

The use of pulse-width modulation techniques also aids in reducing the effects of ambient lighting during the luminance measurement process. The timing diagram of FIG. 3 shows a time period, between times $t_3$ and $t_4$, in which none of the LED arrays are activated. A measurement by detector 26 during this time period would therefore detect light from light sources other than the LED arrays, such as sunlight or artificial light sources. If the luminance of light detected between times $t_3$ and $t_4$ is subtracted from the luminance of the red, green, and blue LED arrays, ambient light effects are substantially removed from the luminance and chromaticity calculations.

Figure 4:
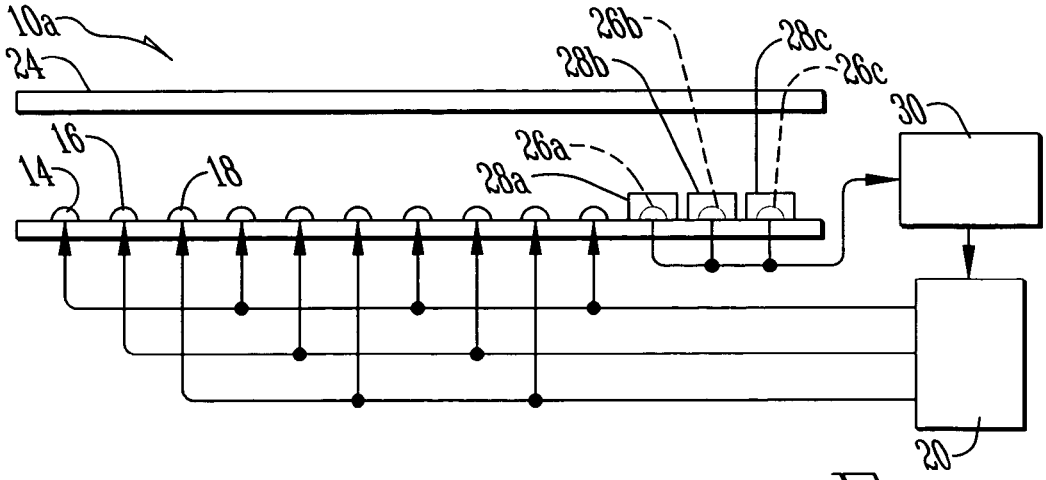
FIG. 4 is a schematic side elevational view of an LED-based LCD backlight according to another embodiment of the invention.

FIG. 4 depicts another embodiment of the invention that may be used in applications where pulse-width modulation techniques may not be available or where such techniques are undesirable. The LCD backlight system 10*a* according to this embodiment includes first, second, and third detectors 26*a*, 26*b*, 26*c*. First detector 26*a* detects light according to the standard $\bar{x}$ chromaticity function. Second detector 26*b* detects light according to the standard $\bar{y}$ chromaticity function. Third detector 26*c* detects light according to the standard $\bar{z}$ chromaticity function. Color matching filters 28*a*, 28*b*, and 28*c* are placed between waveguide 24 and detectors 26*a*, 26*b*, and 26*c* as shown. Tri-stimulus values X, Y, and Z are derived from the detected $\bar{x}$, $\bar{y}$, and $\bar{z}$ chromaticity functions, and chromaticity values u' and v' are then calculated according to known algorithms. As previously stated, the luminance value of the detected light is proportional to the Y tri-stimulus value. Differences between calculated and desired chromaticity and/or luminance may be corrected by varying the current sent to one or more of red, green, and blue LED arrays 14, 16, 18. By balancing the current sent to the LED arrays in this manner, the output of LCD backlight 10*a* may be effectively controlled.

Figure 5:
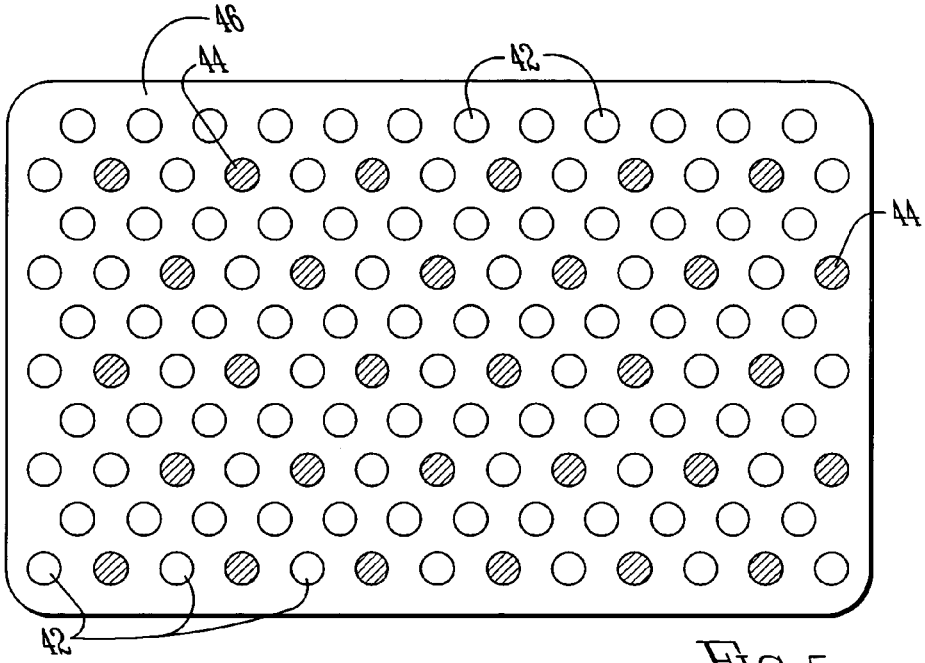
FIG. 5 is a vertical plan view of an LED-based LCD backlight according to still another embodiment of the invention.
Figure 6:
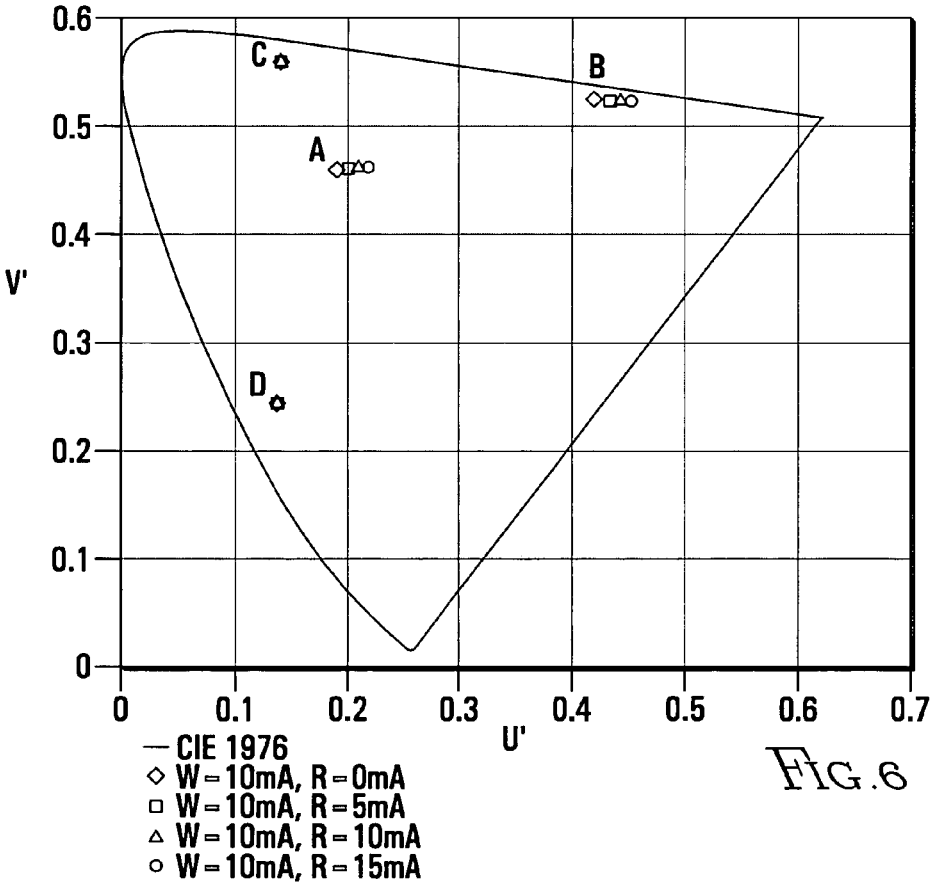
FIG. 6 is a chromaticity diagram showing the effects of the embodiment shown in FIG. 5.

The invention may be used to effect real time chromaticity control of an LCD backlight. Changing the backlight chromaticity depending on the type of information displayed may make the display more readable. For example, if the information being displayed on an avionics display changes from video to weather radar, the chromaticity of the backlight could also be changed to produce a chromaticity optimized for the new information being displayed. As another example, an LCD backlight used in an avionics display may be required to adjust luminance levels to 0.05 fL or less during night flying. At such levels it can be difficult to see red display text and symbology. Red luminance may be increased to adapt to the new conditions. Such an LCD display is shown in FIG. 5, in which a plurality of white LEDs 42 and a plurality of red LEDs 44 are mounted on a printed wiring board 46. As with previous embodiments, the differently colored LEDs are intermixed on the printed wiring board. When it is desired to change the red luminance, the current flowing to red LEDs 44 is changed relative to the current flowing to white LEDs 42. FIG. 6 is a chromaticity diagram upon which is plotted exemplary effects of such current changes. As shown in the key adjacent the diagram, the current flowing to white LEDs 42 is held constant at 10 milli-amperes, while the current flowing to red LEDs 44 is varied from 0 to 15 milli-amperes. It can be seen in FIG. 6 that varying the electrical current to red LEDs 44 changes the chromaticity of light output by the backlight at color points A and B. However, varying the electrical current to red LEDs does not change the chromaticity of light output by the backlight at color points C and D.

The invention may be varied while keeping with the spirit of the invention as herein described. For example, the exact number and color of the LEDs may be selected according to backlight requirements. The light-mixing methodology may include one or more of a bulk diffuser, holographic diffusers, waveguide, free-space propagation, or the like. If a waveguide is used, part or all of the LEDs may be disposed along an edge of the waveguide to create what is generally known as an edge-lit waveguide. The detectors may be placed anywhere that is convenient, as long as the detectors can detect the light from the LEDs.

The invention as disclosed herein provides a method of monitoring and controlling, in real time, both the chromaticity and luminance of an LCD backlight. An advantage of the invention is that expensive sensing systems are not required to provide such real-time control.

Another advantage is that, in at least one embodiment, a single detector may be used to obtain luminance information about a plurality of differently-colored light sources. Staggered pulse-width modulation techniques isolate each of the colors so that the detector can accurately measure the light of each of the light sources.

Another advantage is that ambient light, such as sunlight, may also be measured and mitigated using the disclosed techniques of the invention. This feature substantially eliminates display "washout" that is typically (but not exclusively) encountered when sunlight directly contacts an LCD display screen.

Still another advantage is that the invention may be used with LCD backlights employing red, green, and blue LED arrays as well as other color schemes, such as white and red LED arrays.

Yet another advantage is that the invention may be used with LED-based LCD backlights using pulse-width modulation controls as well as LCD backlights using current modification techniques to vary backlight luminance.

Yet another advantage is that the invention may be used with LCD backlights that use other types of illumination, such as fluorescent lighting.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. A variably controlled LCD backlight, comprising:

a first light source emitting light within a first spectral power distribution and having a first radiant power output;

a second light source emitting light within a second spectral power distribution and having a second radiant power output;

a detector configured to detect the first and second radiant power outputs;

a processor, connected to the detector, that calculates chromaticity and luminance values of the emitted light based on the first and second radiant power outputs, the processor further configured to compare the calculated chromaticity and luminance values with desired chromaticity and luminance values, respectively; and a controller, operationally connected to the processor, that is configured to adjust one or more of the first radiant power output and the second radiant power output in response to a difference between the calculated chromaticity and luminance values and the desired chromaticity and luminance values.

2. The backlight of claim 1, wherein the first light source is a first array of light-emitting diodes, and wherein the second light source is a second array of light-emitting diodes.

3. The backlight of claim 2, wherein the first array of light-emitting diodes emits red light, the second array of light-emitting diodes emits green light, and further including a third array of light-emitting diodes that emits blue light at a third radiant power output;

wherein the detector is configured to detect the radiant power outputs of the first, second, and third arrays of light-emitting diodes.

4. The backlight of claim 2, wherein the first and second arrays of light-emitting diodes are selectively activated by the controller such that for a first predetermined time, the first array is activated and the second array is not activated;

for a second predetermined time, the second array is activated and the first array is not activated; and for a third predetermined time, the first array and the second array are activated.

5. The backlight of claim 4, wherein the detector is configured to detect the first radiant power output during the first predetermined time, and wherein the detector is configured to detect the second radiant power output during the second predetermined time.

6. The backlight of claim 4, wherein for a fourth predetermined time, neither the first array nor the second array are activated.

7. The backlight of claim 6, wherein an ambient luminance is measured during the fourth predetermined time, and wherein the measured ambient luminance is subtracted from the luminance of light detected during at least one of the first and second predetermined times.

8. The backlight of claim 1, wherein the first light source includes a first fluorescent light, and wherein the second light source includes a second fluorescent light.

9. The backlight of claim 1, wherein the detector is a first detector further configured to detect a first predetermined tri-stimulus value of light emitted by the first and second light sources, the backlight further comprising:

a second detector configured to detect a second predetermined tri-stimulus value of light emitted by the first and second light sources; and a third detector configured to detect a third predetermined tri-stimulus value of light emitted by the first and second light sources, wherein the processor is further connected to the second detector and the third detector and is configured to calculate chromaticity and luminance values of emitted light based on the first, second, and third predetermined tri-stimulus values detected by the first, second, and third detectors.

10. The backlight of claim 1, wherein the controller selectively adjusts the first and second radiant power outputs by varying electrical current to the first and second light sources, respectively.

11. The backlight of claim 1, wherein the controller is configured to control current to the first and second light sources using pulse-width modulation, and further wherein the first and second radiant power outputs are selectively adjusted by altering a pulse-width modulation pattern to one of the first and second light sources.

12. A method of controlling chromaticity and luminance levels of an LCD backlight, comprising:

providing a first light source that emits light within a first spectral power distribution;

providing a second light source that emits light within a second spectral power distribution;

detecting a predetermined tri-stimulus value of light emitted by the first and second light sources;

calculating chromaticity and luminance values of the emitted light based on the predetermined tri-stimulus value;

comparing the calculated chromaticity and luminance values with desired chromaticity and luminance values, respectively; and adjusting one or more of an intensity of the first light source and an intensity of the second light source in response to a difference between the calculated chromaticity and luminance values and the desired chromaticity and luminance values.

13. The method of claim 12 wherein the first light source and the second light source emit light such that for a first predetermined time, the first light source is activated and the second light source is not activated;

for a second predetermined time, the second light source is activated and the first light source is not activated; and for a third predetermined time, the first light source and the second light source are activated;

wherein the predetermined tri-stimulus value of the first light source is detected during the first predetermined time, and the predetermined tri-stimulus value of the second light source is detected during the second predetermined time.

14. The method of claim 13, further including measuring an ambient luminance during a fourth predetermined time when neither the first light source nor the second light source are activated.

15. The method of claim 12, wherein the adjusting is accomplished by adjusting an amount of electrical current powering at least one of the first light source and the second light source.

16. An optical feedback and control system for an LCD backlight having a first light source and a second light source, each of the light sources emitting light having a different spectral power distribution, the system comprising:

a detector configured to detect radiant power of light emitted by the first and second light sources;

a processor, connected to the detector, that calculates chromaticity and luminance values of the emitted light based on the detected radiant power and the spectral power distribution of each of the first and second light sources, the processor further configured to compare the calculated chromaticity and luminance values with desired chromaticity and luminance values, respectively;

a controller, operationally connected to the processor, that is configured to adjust one or more of the radiant power of the first light source and the radiant power of the second light source in response to a difference between the calculated chromaticity and luminance values and the desired chromaticity and luminance values.

17. The optical feedback and control system of claim 16, wherein the first and second light sources are selectively activated by the controller such that for a first predetermined time, the first light source is activated and the second light source is not activated;

for a second predetermined time, the second light source is activated and the first light source is not activated; and for a third predetermined time, the first light source and the second light source are activated.

18. The optical feedback and control system of claim 17, wherein the detector is configured to detect the radiant power of the first light source during the first predetermined time, and wherein the detector is configured to detect the radiant power of the second light source during the second predetermined time.

19. The optical feedback and control system of claim 17, wherein for a fourth predetermined time, neither the first light source nor the second light source are activated, and wherein an ambient luminance is measured during the fourth predetermined time.

* * * * *